United States Patent [19]

Anderson

[11] Patent Number: 4,771,966

[45] Date of Patent: Sep. 20, 1988

[54] PAPER TOWEL HOLDER

[76] Inventor: Carl J. Anderson, 893 Evangeline Ave., Orlando, Fla. 32809

[21] Appl. No.: 115,825

[22] Filed: Nov. 2, 1987

[51] Int. Cl.[4] ..... B65H 19/10

[52] U.S. Cl. ..... 242/55.2; 225/51

[58] Field of Search ..... 242/55.2, 75.4, 75.41; 225/46, 67, 106, 51

[56] References Cited

U.S. PATENT DOCUMENTS

| | | | |
|---|---|---|---|
| 301,596 | 7/1884 | Hopking | 242/55.2 |
| 533,266 | 1/1895 | Brandt | 225/67 |
| 1,091,450 | 3/1914 | Anable | 225/67 |
| 1,391,326 | 9/1921 | Killian | 242/55.2 |
| 1,913,363 | 6/1933 | Allen | 242/55.2 |
| 2,164,064 | 6/1939 | Harvey | 242/55.2 |

*Primary Examiner*—David Werner

*Attorney, Agent, or Firm*—William M. Hobby

[57] ABSTRACT

A paper towel holder apparatus has a base plate mountable on a support surface and a means for rotatably holding a roll of paper towels for rotation of the roll of towels on its axis. An arcuate frame has a cylindrical brake bar mounted on one side thereof and fasteners rotatably fastening the arcuate frame to the base plate below the center axis and parallel to the center axis of a roll of paper towels held in the paper towel holder. The arcuate frame brake extends parallel to the axis of the roll of paper towels and is supported on the roll of towels along the top of the roll so that the arcuate frame extends at least 90° around a roll of paper towels to prevent the towels from being blown by air movement and to provide a brake for tearing the paper towels.

3 Claims, 1 Drawing Sheet

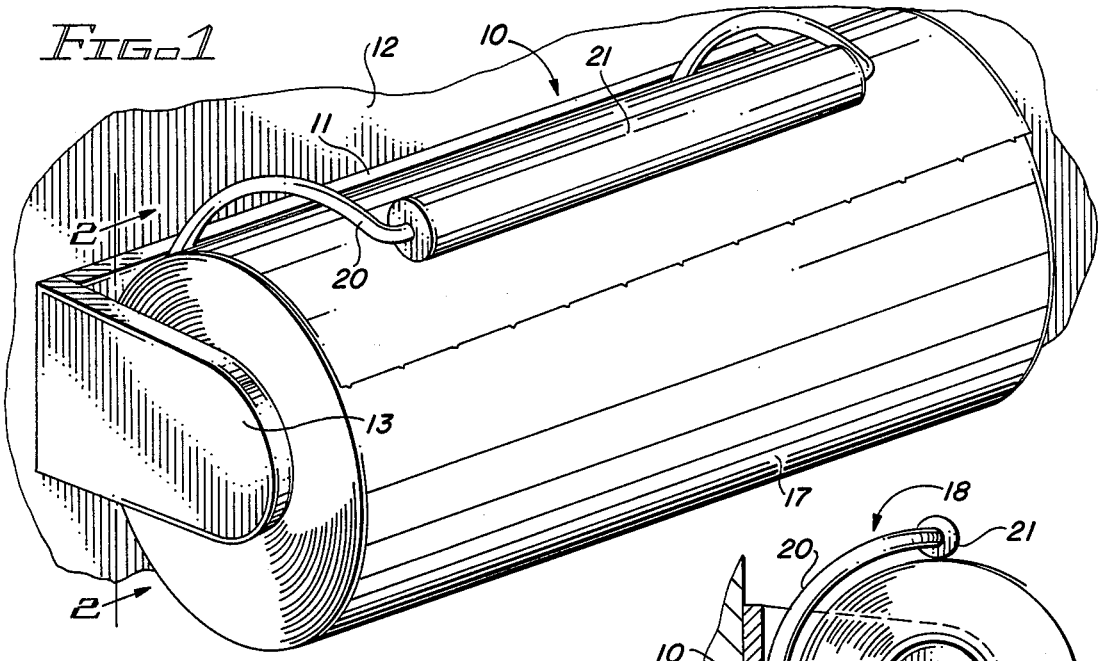
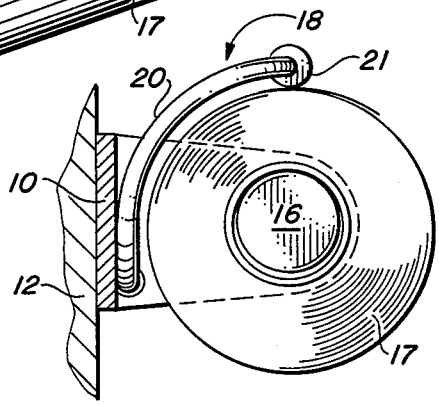
FIG. 2
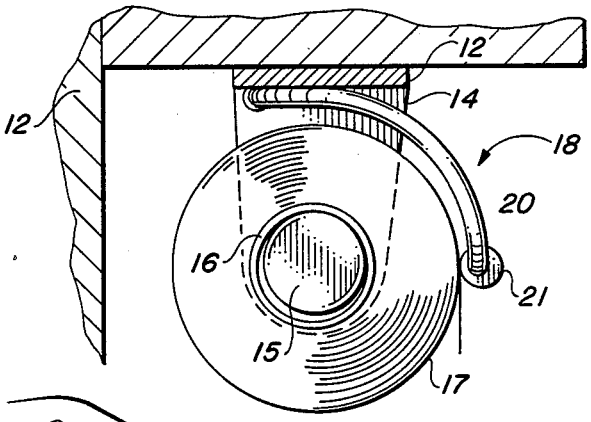
FIG. 3
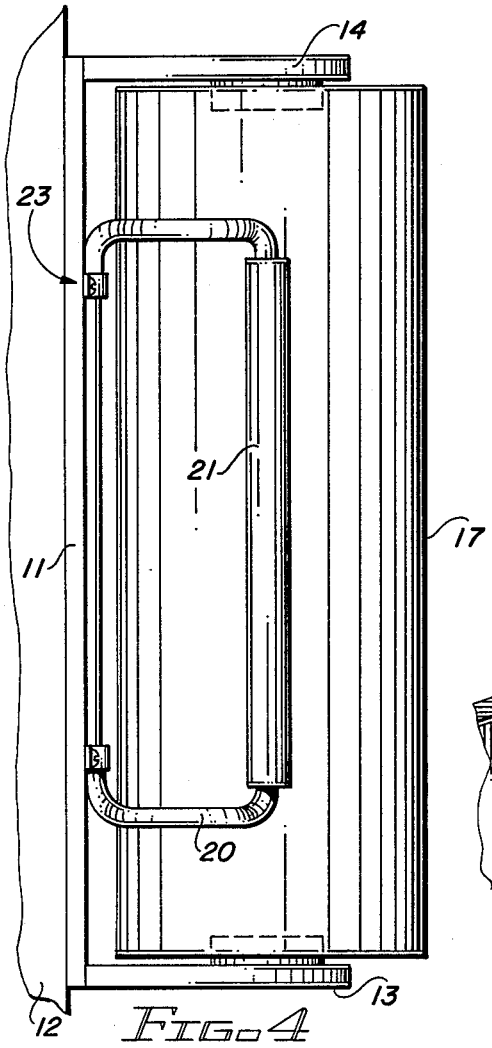
FIG. 4
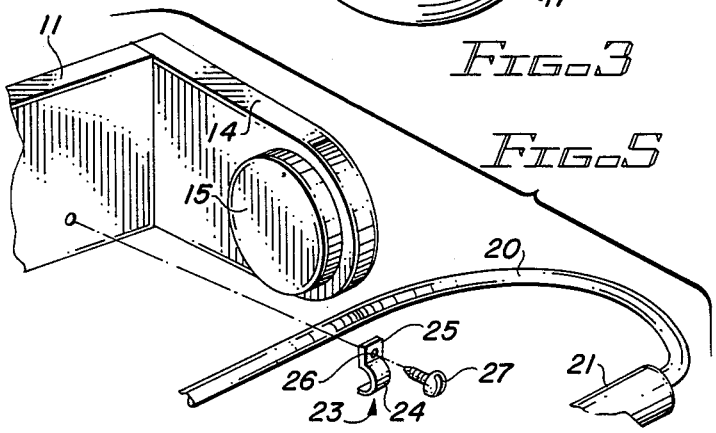
FIG. 5

PAPER TOWEL HOLDER

BACKGROUND OF THE INVENTION

The present invention relates to a paper towel holder and particularly to a paper towel holder for paper towels to be pulled therefrom and torn along perforated lines in the roll of towels.

In the past, there have been roll holders for paper towels, aluminum foil, synthetic plastic foil, and the like and typically these holders include a holding or suspension portion with inherent braking and sometimes have a tear surface for tearing a piece of material from the roll. Typical paper towel roll holders have the paper towels rolled on a paperboard tube which is rotatably held on each end on a cylindrical tube holder shaped inside to fit in each end of a paper towel tube. The tube holder of the paper towel holder may be tapered to provide enough friction on the tube to allow tearing along perforations. Some prior art paper holders provide additional braking action to assure a more adequate tear along the perforations.

Prior art U.S. patents which show roll holders can be seen in the Kurz, et al, U.S. Pat. No. 4,556,160 for a roll holder having a base plate. This patent has a pair of yokes pivotally supported on the base plate. The roll is held to one square bar and a second yoke is positioned so that the paper can be pulled through the yoke over one edge for tearing the paper. In the Kishi, et al, U.S. Pat. No. 3,918,661, a paper roll holder is provided with a supporting back plate and side plates projecting therefrom for holding a roll of paper on a tube. This patent has a lid connected to the back plate with a roller extending longitudinally along the edge of the lid along the front portion thereof and abutting on the periphery of the paper roll. The Tsunetsugu U.S. Pat. No. 4,381,083 is for a toilet paper holder similar to the Kishi patent and has a back plate with extending side plates. The side plates are connected with a spool for holding the paper roll and a hinged top plate rests on top of the paper roll. The present invention is similar to the prior art in that it has a base plate for mounting to a wall and has a cylindrical brake bar mounted but it does not form a cover for the paper. Rather the paper towels are held in place in a recreational vehicle or the like, to keep the towels from blowing in the breeze and unraveling from the roll. This is accomplished by mounting an arcuate frame to the bottom portion of the back plate and having the arcuate frame extend up and over the roll of paper for the cylindrical brake bar to ride on top of the roll of paper and by having a rod-like frame which will not be blown up and down by a hinged surface lid as the breeze blows past the roll of paper towels.

SUMMARY OF THE INVENTION

A paper towel holder is especially adapted for use in recreational vehicles and prevents the movement of air from unraveling a roll of paper towels. A base plate is mountable on a support surface and has means for rotatably holding the roll of paper towels for rotation of the roll of towels on its center rolling axis. An arcuate frame has a cylindrical brake bar mounted on one side thereof and fasteners rotatably fasten the arcuate frame to the lower portion of the base plate below the center of and parallel to the center axis of a roll of paper towels held in the paper towel holder. The arcuate brake frame bar extends parallel to the axis of the roll of paper towels and is supported thereon along the top of the paper towels to provide tilting arcuate frame formed of heavy rod or thin tubing.

BRIEF DESCRIPTION OF THE DRAWINGS

Other objects, features, and advantages of the present invention will be apparent from the written description and the drawings in which:

FIG. 1 is a perspective view of a paper towel holder in accordance with the present invention;

FIG. 2 is a sectional view taken on line 2—2 of FIG. 1;

FIG. 3 is a sectional view in accordance with FIG. 2 having a paper towel holder mounted to a top surface;

FIG. 4 is a top plan view of the paper holder in accordance with FIG. 1; and FIG. 5 is an exploded perspective view of one end of the paper towel holder in accordance with FIGS. 1 through 4.

DESCRIPTION OF THE PREFERRED EMBODIMENT

Referring to FIGS. 1 through 5 of the drawings a paper towel holder 10 has a base plate 11 mountable on a supporting surface wall 12 with screws, adhesive, or adhesive tape. The base plate has two protruding end portions 13 and 14 each having a cylindrical support 15 for holding a cardboard or paper tube 16 having a roll of paper towels 17 rolled thereon. An arcuate frame 18 may be made of aluminum rod having a pair of arcuate sides 20 with a brake bar 21 extending along one edge parallel to a straight second edge 22. The edge 22 is rotatably mounted with a pair of fasteners 23 having an arcuate holding portion 24 and a flat attaching portion 25 having an aperture 26 therein. A threaded fastener or screw 27 is passed through the aperture 26 to bolt fastener 23 into the back plate 11 well below the axis 30 of the roll of paper 17. The frame 18 thus can rotate on the fasteners 23 with the arcuate sides 20 extending around the roll of paper 17 from a position below the center axis 30 and attached to the bottom portion of the back plate 11 around the paper roll 17 so that the brake bar 21 rests almost directly on top of the roll of paper 17 with the arcuate sides 20 of the frame extending more than 90° around the roll of paper 17.

The frame 18 may be formed of a heavy aluminum rod, or the like, having a plastic brake bar 21 of an elongated cylindrical shape rotatably attached thereto and rotatably attached to the back plate 11 with the fasteners 23. The frame 18 does not have a wide surface to build up pressure differentials between sides thereof so as to easily raise and lower the framework in an air breeze. The present invention is especially adapted for attaching to recreational vehicles which are moved rapidly on a highway and may have air blowing through windows which can rapidly unravel the paper towels. The positioning of the brake bar 21 and the positioning of the rotating frame 18 on the back plate 11 prevent the unraveling of the paper due to the movement of air and allows a person to grasp the end of the paper 31 and pull the paper to the next perforation line to tear the paper from the roll.

It should be clear that a paper towel holder has been provided which is especially useful in recreational vehicles, campers, and the like to prevent the unraveling of the paper during travel but which also allows much more rapid removal of paper towels without having to grasp a roll of paper towels during the tearing of a paper towel from the roll. However, the present invention is not to be construed as limited to the form shown which is to be considered illustrative rather than restrictive.

I claim:

1. A paper towel apparatus comprising:

a base plate mountable on a support surface, said base plate having means for rotatably holding a roll of paper towels for rotation of the roll of towels on a center rolling axis;

an arcuate frame formed of a metal rod having an elongated cylindrical polymer brake bar roller mounted on one side thereof;

said arcuate frame having two arcuate sides and two straight sides with one of the straight sides having said brake bar roller thereon;

fastener means for rotatably fastening said arcuate frame to said base plate below the center of and parallel to the center axis of a roll of paper towels held in said paper towel holder;

said fastener means having a pair of fastening brackets, each having an arcuate surface for holding said arcuate frame and a flat portion having an aperture therein for attaching said fastening brackets to the base plate; and said arcuate frame brake bar extending parallel to the axis of said roll of paper towels and being supported thereon along the top of said roll of towels, whereby said arcuate frame extends at least ninety degrees around a roll of paper towels to prevent said towels from being blown by air movement and to allow a surface for tearing a paper towel against.

2. A paper towel holder in accordance with claim 1 in which said arcuate frame is made of aluminum rod.

3. A paper towel holder in accordance with claim 1 in which said arcuate frame has a pair of arcuate sides extending more than ninety degrees around said paper towel elongated center axis.

* * * * *